US009396713B2

(12) United States Patent
Ikeda

(10) Patent No.: US 9,396,713 B2
(45) Date of Patent: Jul. 19, 2016

(54) MUSIC BOX FOR SUPPRESSING NOISE

(71) Applicant: BROTHER KOGYO KABUSHIKI KAISHA, Nagoya, Aichi (JP)

(72) Inventor: Akihiro Ikeda, Obu (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 14/315,465

(22) Filed: Jun. 26, 2014

(65) Prior Publication Data

US 2015/0000499 A1 Jan. 1, 2015

(30) Foreign Application Priority Data

Jun. 28, 2013 (JP) ..... 2013-137509

(51) Int. Cl.
*G10F 1/06* (2006.01)

(52) U.S. Cl.
CPC ..... *G10F 1/06* (2013.01)

(58) Field of Classification Search
USPC ..... 84/101
See application file for complete search history.

(56) References Cited

U.S. PATENT DOCUMENTS

| | | | | | |
|---|---|---|---|---|---|
| 5,877,439 | A | * | 3/1999 | Asakawa et al. | 84/95.1 |
| 5,949,004 | A | * | 9/1999 | Orii et al. | 84/95.1 |
| 5,973,240 | A | * | 10/1999 | Isaka | 84/97 |
| 6,013,867 | A | * | 1/2000 | Isaka | 84/97 |
| 6,051,763 | A | * | 4/2000 | Poux | 84/95.1 |
| 2004/0065184 | A1 | | 4/2004 | Isaka et al. | |

FOREIGN PATENT DOCUMENTS

WO WO 02058048 A1 7/2002

* cited by examiner

*Primary Examiner* — Christopher Uhlir
(74) *Attorney, Agent, or Firm* — Scully, Scott, Murphy & Presser, P.C.

(57) ABSTRACT

A music box includes a bedplate, a plurality of projections, a driving mechanism, an enclosure, a first member, and a second member. The bedplate is fixedly provided with a plurality of vibration reeds. One or more projections are provided to correspond to each of the plurality of vibration reeds. The driving mechanism is configured to drive the plurality of projections. The enclosure accommodates therein the bedplate and the driving mechanism and comprising a resonant plate. The first member is fixed to the resonant plate of the enclosure and the bedplate accommodated in the enclosure. The second member is provided between the driving mechanism and the enclosure.

3 Claims, 7 Drawing Sheets

MUSIC BOX FOR SUPPRESSING NOISE

CROSS REFERENCE TO RELATED APPLICATION

This application claims priority from Japanese Patent Application No. 2013-137509 filed Jun. 28, 2013. The entire content of the priority application is incorporated herein by reference.

TECHNICAL FIELD

The present invention relates to a music box, and particularly to an improved music box that suppresses noise to achieve a desired sound quality.

BACKGROUND

Music boxes that play music are well known in the art. One such music box includes a vibration plate having a plurality of vibration reeds, and a drive mechanism that drives claws to pluck the vibration reeds, for example. The vibration reeds correspond to different pitches and, when plucked by a claw, produce sound at the corresponding pitch. The music box has a music box mechanism for producing sounds, and a sound board for transmitting the sounds produced by the music box mechanism. Columns are provided for supporting the sound board and are fixed to another plate constituting the enclosure of the music box. This configuration enables the columns supporting the sound board to transmit sounds produced by the music box mechanism effectively through the entire enclosure of the music box.

SUMMARY

However, the music box mechanism supported on the sound board includes both the vibration plate provided with the plurality of vibration reeds and the drive mechanism that drives claws to pluck the vibration reeds. Further, while the music box plays a note while plucking a vibration reed, the drive mechanism that plucks the vibration reed also produce a drive noise. Therefore, when both the vibration reeds and the drive mechanism are supported on the sound board, both the sound produced from the vibration reed when the vibration reed is plucked and the drive noise of the drive mechanism are transmitted through the sound board and resonate in the entire enclosure of the music box. In other words, when sound is produced by a vibration reed, the sound board may amplify not just this sound, but also noise caused by the drive noise of the drive mechanism.

The inventors of the present example came across this problem while conducting thorough ongoing research aimed at improving the acoustic quality of music boxes.

In view of the foregoing, it is an object of the present disclosure to provide a music box that minimizes the generation of unwanted noise to achieve a desired sound quality.

In order to attain the above and other objects, the present disclosure provides a music box. The music box may include a bedplate, a plurality of projections, a driving mechanism, an enclosure, a first member, and a second member. The bedplate may be fixedly provided with a plurality of vibration reeds. One or more projections are provided to correspond to each of the plurality of vibration reeds. The driving mechanism may be configured to drive the plurality of projections. The enclosure may accommodate therein the bedplate and the driving mechanism and comprising a resonant plate. The first member may be fixed to the resonant plate of the enclosure and the bedplate accommodated in the enclosure. The second member may be provided between the driving mechanism and the enclosure.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Next, a music box 10 according to a preferred embodiment of the present disclosure will be described while referring to the accompanying drawings.

In the preferred embodiment, the top of the music box 10 will be considered the uppermost portion of the music box 10 in a general vertical direction when the music box 10 is resting on a flat surface (not shown).

Figure 1:
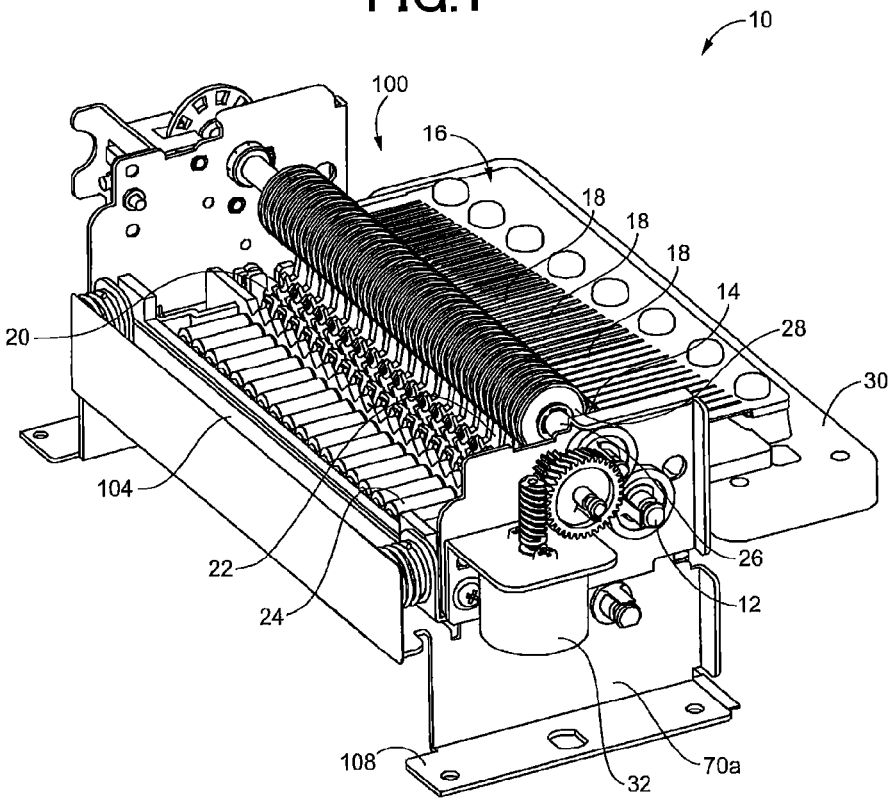
FIG. 1 is a schematic perspective view of a music box according to one or more aspects of the disclosure.

As shown in FIG. 1, the mechanical performance unit 100 includes a first shaft 12; a plurality (forty in this example) of star wheels 14 rotatably provided on the first shaft 12; a vibration plate 16 provided alongside the first shaft 12 and each having a plurality of vibration reeds 18 juxtaposed along the first shaft 12 at positions corresponding to the star wheels 14; a pair of second shafts 20 arranged along the first shaft 12, and preferably parallel to the first shaft 12; a plurality of stoppers 22 pivotally movable about each of the second shafts 20 and provided at positions corresponding to the each of the star wheels 14; a plurality of electromagnets 24 disposed in positions corresponding to the stoppers 22; a third shaft 26 arranged parallel to the first shaft 12; a plurality of sun wheels 28 provided on the third shaft 26 at positions corresponding to the star wheels 14 so as to rotate together with and not relative to the third shaft 26; an assembly frame 104 for rotatably supporting the first shaft 12 and the third shaft 26 about their center axes, non-rotatably supporting the second shafts 20 and serving as a mount base for the plurality of electromagnets 24; a bedplate 30 on which the vibration plate 16 is fixed; and a motor 32 adapted to produce a drive force for driving the first shaft 12 and the third shaft 26 to rotate about their axes in synchronization. The vibration reeds 18 correspond to discrete predetermined pitch (musical tones) and produce a sound at the corresponding tone when plucked by a claw 36 (described later) on the corresponding star wheel 14. As described below, the star wheels 14, the sun wheels 28, and the stoppers 22 is an example of a drive mechanism 102. The mechanical performance unit 100 shown in FIG. 1 is accommodated in an enclosure 34 of the music box 10 described below by assembling a second frame 70*b* or the like to the enclosure 34.

Figure 4:
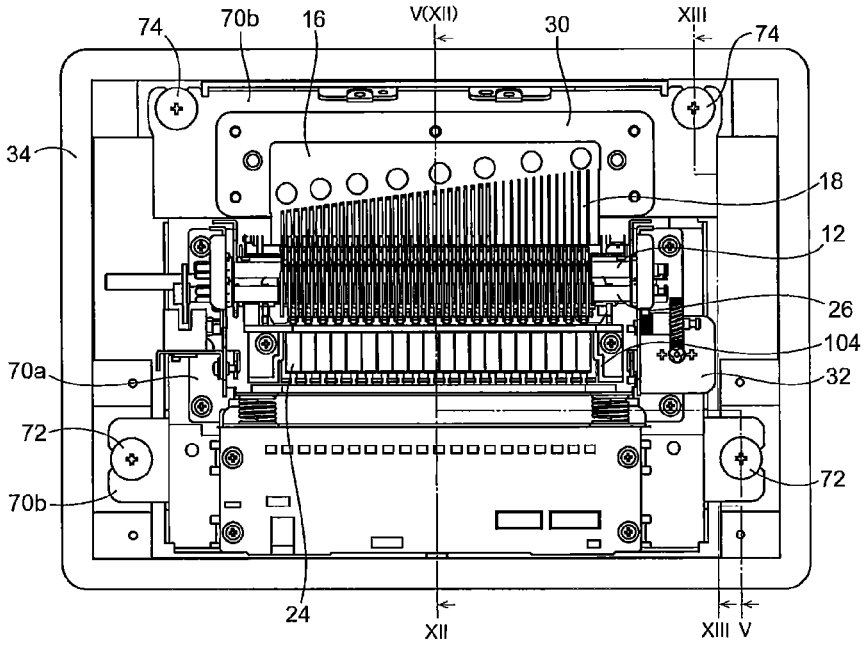
FIG. 4 is a plane view of the mechanical performance unit accommodated in an enclosure according to one or more aspects of the disclosure.
Figure 5:
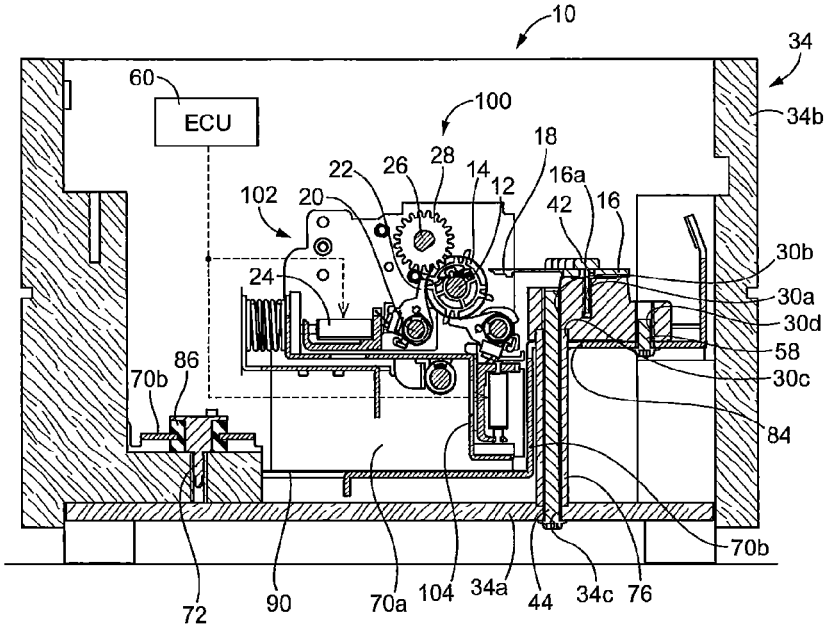
FIG. 5 is a cross-sectional view of the music box taken along a line V-V in FIG. 4 according to one or more aspects of the disclosure.

As shown in FIGS. 4 and 5, the music box 10 is provided with the enclosure 34 for accommodating therein the first shaft 12, the star wheels 14, the vibration plate 16, the second shaft 20, the stoppers 22, the electromagnets 24, the third shaft 26, the sun wheels 28, and other components. The first shaft 12, the star wheels 14, the second shaft 20, the stoppers 22, the electromagnets 24, the third shaft 26, and the sun wheels 28 are mounted on the assembly frame 104. The assembly frame 104 is assembled on a first frame 70*a*. The first frame 70*a* in turn is fixed to a second frame (lower plate) 70*b* by screws 106 (see FIGS. 12 and 14). The bedplate 30 on which the vibration plate 16 is mounted is fixed to the second frame 70*b*. The second frame 70*b* is fixed to the enclosure 34 by screws 72 and 74. The assembly frame 104, the first frame 70*a*, and the second frame 70*b* are preferably configured as separate members.

The mechanical performance unit 100 having the structure shown in FIG. 1 is accommodated in the enclosure 34 by fixing the second frame 70*b* to the enclosure 34. That is, the music box 10 is provided with the second frame 70*b* for fixing, to the enclosure 34, the bedplate 30 and the drive mechanism 102 including the star wheels 14, the sun wheels 28, and the stoppers 22. The second frame 70*b* in the preferred embodiment corresponds to a frame for fixing the bedplate 30 and drive mechanism 102 to the enclosure 34.

The enclosure 34 preferably includes a bottom plate 34*a* as an example of a resonant plate for resonating with the vibrations of the vibration reeds 18, and side walls 34*b* erected vertically on the bottom plate 34*a* to surround all four sides of the enclosure 34. In other words, the four edges of the bottom plate 34*a* are fixed to the side walls 34*b* of the enclosure 34. Thus, when the music box 10 plays a song, not only the bottom plate 34*a*, but also the side walls 34*b* tend to resonate with the vibrations of the vibration reeds 18. Hence, the side walls 34*b* also function as resonant plates for resonating with the vibrations of the vibration reeds 18.

The bedplate 30 is fixed either directly or indirectly to the bottom plate 34*a*. The bedplate 30 is preferably fixed to the bottom plate 34*a* indirectly via a sound post 76 for connecting the bedplate 30 with the bottom plate 34*a*. The sound post 76 is a columnar or cylindrical shaped vibration-transmitting member that is directly fixed to the bedplate 30 and directly fixed to the bottom plate 34*a*. In other words, the sound post 76 is a supporting post interposed between the bedplate 30 and the bottom plate 34*a*. The sound post 76 is preferably provided at a position set back from the edges of the bottom plate 34*a* toward the interior of the enclosure 34 (i.e., inside the side walls 34*b*).

In the description of the embodiment, a single sound post 76 is interposed between the bedplate 30 and the bottom plate 34*a*, but two or more sound posts 76 may be interposed instead. Alternatively, the bedplate 30 may be placed directly on and fixed to the bottom plate 34*a*. In other words, the sound post 76 is not essential. The sound post 76 in the preferred embodiment is an example of a first member that is both fixed to the bedplate 30 and fixed to the bottom plate 34*a*.

As shown in FIG. 5, the music box 10 also includes an electric control unit (ECU) 60 for controlling the excitation and non-excitation of each electromagnet 24.

Figure 3:
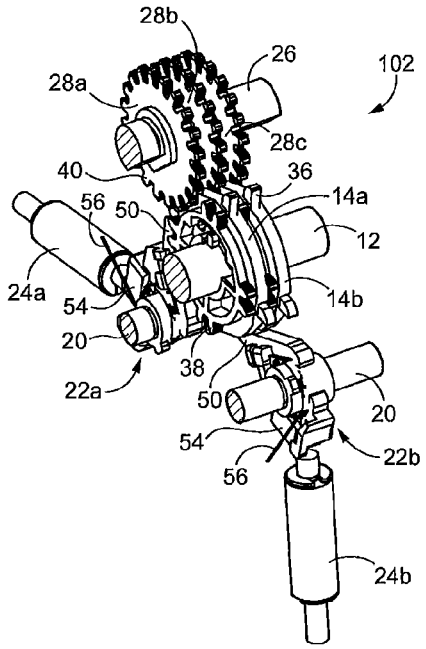
FIG. 3 is a perspective view of the mechanical performance unit shown in FIG. 2 according to one or more aspects of the disclosure.

The example of FIG. 3 shows sun wheels 28*a* and 28*b* corresponding to the star wheels 14*a* and 14*b*, as well as a sun wheel 28*c* neighboring the sun wheel 28*b*. Here, a neighboring sun wheel 28 is a sun wheel 28 positioned next to another sun wheel 28 along the third shaft 26. In all drawings other than FIG. 3, when it is not necessary to distinguish among individual star wheels 14*a* and 14*b*, each star wheel is simply referred to using the reference numeral 14. Similarly, stoppers are simply referred to using the reference numeral 22 when it is not necessary to distinguish between individual stoppers 22*a* and 22*b*, and sun wheels are simply referred to using the reference numeral 28 when it is not necessary to distinguish among individual sun wheels 28*a*, 28*b*, and 28*c*.

Figure 2:
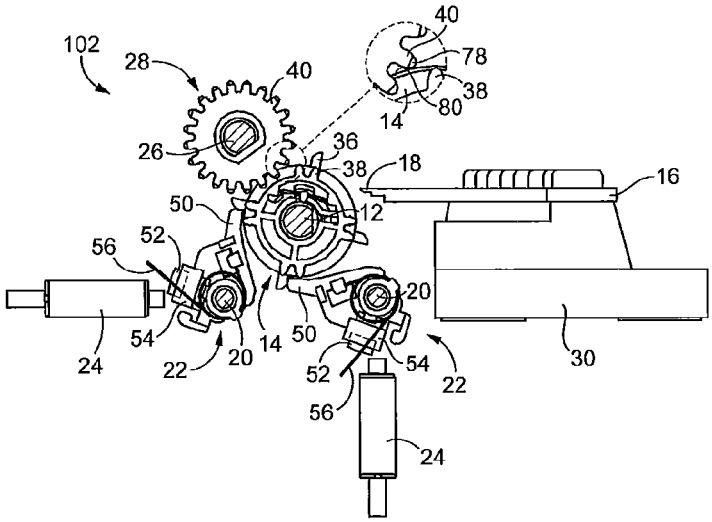
FIG. 2 is a schematic view showing a mechanical performance unit of the music box as viewed from an axial direction of a first shaft according to one or more aspects of the disclosure.

Note that the assembly frame 104, the sound post 76, and the like have been omitted from FIG. 2, as well as from FIGS. 6 through 9. Also, the vibration plate 16, the assembly frame 104, the bedplate 30, and the like have been omitted from FIG. 3, while portions of the first shaft 12, the second shaft 20, and the third shaft 26 are also omitted (cut).

As shown in FIGS. 2 and 3, each star wheel 14 is provided with a plurality of claws 36 as an example of projections protruding radially outward from the peripheral edge thereof. Preferably, four of the claws 36 are provided at equal intervals, i.e., at every 90 degrees, around the periphery of the star wheel 14 in the circumferential direction thereof. A plurality of gear teeth 38 are formed at a position radially inside of the claws 36. Preferably two of the gear teeth 38 are provided at positions corresponding to each claw 36. The gear teeth 38 are arranged between the star wheel 14 and the adjacent star wheel 14 in the first shaft 12 and, hence, are disposed at different positions from the claws 36 with respect to the axial direction of the first shaft 12. In other words, the gear teeth 38 are positioned between pairs of neighboring claws 36 with respect to the axial direction of the first shaft 12.

Each sun wheel 28 is provided with a plurality of gear teeth 40 around its peripheral edge. When the star wheel 14 is assembled on the first shaft 12 as shown in FIG. 2, the claws 36 are disposed at positions for contacting at least a portion of the vibration reed 18 aligned with the rotational path of the claws 36 upon the rotation of the star wheel 14 about the first shaft 12. Further, the positions of the claws 36 are disposed at positions such that the stopper 22 can engage the claws 36 in an anchoring state described later. That is, when the stopper 22 contacts one of the claws 36, the star wheel 14 is prevented from following the rotation of the first shaft 12. By contacting the claw 36 after the claw 36 has plucked the corresponding vibration reed 18 on the vibration plate 16, the stopper 22 functions as a stopper for preventing the star wheel 14 from continuing to follow the rotation of the first shaft 12. The rotational path of the gear teeth 38 about the axial center of the first shaft 12 is aligned with the corresponding gear teeth 40 of the sun wheel 28 so that the gear teeth 38 can engage with the gear teeth 40 provided on the sun wheel 28.

As illustrated in the enlarged view of FIG. 2 (the portion encircled by a dashed line), the gear teeth 40 of the sun wheel 28 is formed with chamfered edges 78 at the distal ends of the gear teeth 40 and preferably on both sides in the axial direction of the sun wheel 28. Chamfered edges 80 (see FIG. 4) are formed on the outer circumferential edges of the star wheels 14. The star wheel 28 defines an outer circumferential surface 72 formed with the chamfered edges 80. The star wheel 14 has two outer edges in the axial direction on the outer circumferential surface 72.

At least one of the chamfered edges 78 on the sun wheel 28 and the chamfered edges 80 on the star wheel 14 may be formed. In addition to the chamfered edges 80 formed in the circumferential surface 72 of the star wheel 14, chamfered edges may be formed in the edges of the claws 36 (both axial edges) and the like.

As shown in FIG. 2, the stopper 22 includes a plate member 50, a magnetic member 52, a synthetic resin member 54, and a torsion coil spring 56. The plate member 50 is adapted to contact the claw 36 on the corresponding star wheel 14 by rotating the stopper 22 toward the star wheel 14 about the second shaft 20. The magnetic member 52 reacts to the magnetic force of the electromagnet 24 so as to rotate the stopper 22 in a direction for separating the stopper 22 from the star wheel 14. The magnetic member 52 is formed of metal whose primary component is an iron group element, such as iron, cobalt, or nickel. The magnetic member 52 is preferably an iron sheet that is not necessarily magnetized, but may be a permanent magnet (which is magnetized). The magnetic member 52 is formed in the synthetic resin member 54 through insert molding. In other words, the magnetic member 52 is embedded in the synthetic resin member 54. The synthetic resin member 54 is formed of an engineering plastic or the like provided integrally with the plate member 50. This construction can reduce chattering in the magnetic member 52 caused by the attraction of the electromagnet 24. The torsion coil spring 56 urges the stopper 22 to rotate toward the star wheel 14.

The electromagnet 24 is preferably configured of a cylindrical coil disposed around an iron core or other magnetic material. When electricity is supplied to the coil, the electromagnet 24 enters an excitation state in which a magnetic force (magnetic field) is produced. When electricity is not flowing through the coil, the electromagnet 24 remains in a non-excitation state. In other words, the electromagnet 24 is a common electromagnet known in the art.

Figure 14:
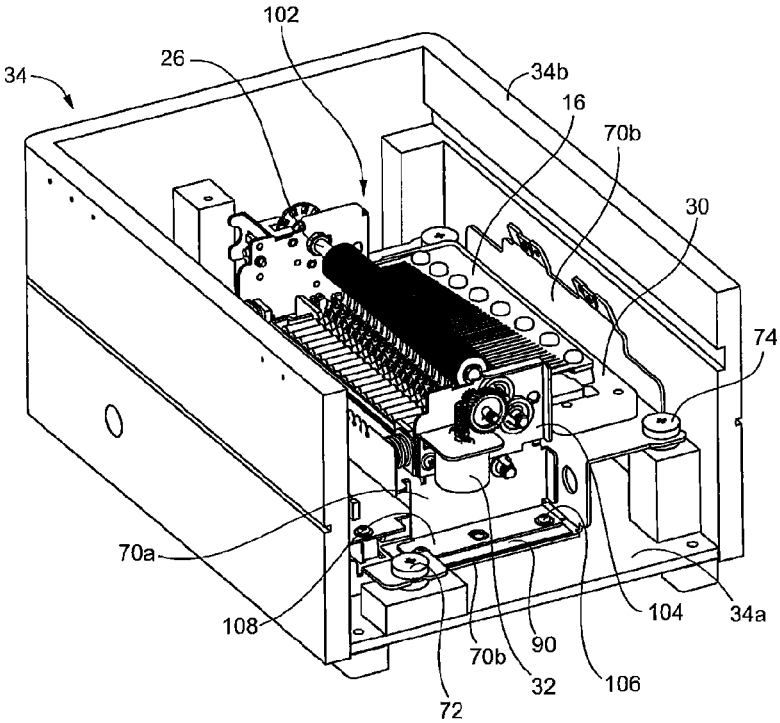
FIG. 14 is a perspective view of the music box without the side wall of the enclosure according to one or more aspects of the disclosure.

As shown in FIG. 14, the ECU 60 includes a musical score database 62, a release timing determination unit 64, and an electromagnet excitation control unit 66.

The musical score database 62 stores data for a plurality of musical scores corresponding to songs or melodies for the music box 10 to play. The musical score database 62 is stored on a storage medium, such as an SD card (Secure Digital card) well known in the art, and the ECU 60 is capable of reading the data stored on the storage medium. The musical scores may be stored in a data format such as MIDI (Musical Instrument Digital Interface) and may include a plurality of tracks (channels) for a predetermined plurality of instrument types, wherein the output timing, tone, and the like for sounds is specified for each instrument. As is described below in greater detail, the music box 10 according to the preferred embodiment can control a musical performance based on output timings, musical tones, and the like of each track corresponding to the melodic theme of the MIDI data, for example.

The release timing determination unit 64 determines a release timing at which each of the stoppers 22 releases the engagement with the claw 36 of the corresponding star wheel 14. In other words, the release timing determination unit 64 determines the release timing for switching the excitation/non-excitation state of the electromagnet 24 corresponding to each of the stoppers 22 (the release timing at which electricity to the electromagnets 24 is conducted and halted). For example, while the mechanical performance unit 100 is performing a melody corresponding to prescribed data for one of the musical scores stored in the musical score database 62, the release timing determination unit 64 performs the above determinations based on the output timing and musical tone for each sound specified in the musical score data. More specifically, the release timing determination unit 64 determines the release timing at which each stopper 22 releases the claw 36 of the corresponding star wheel 14 in order that the vibration reeds 18 corresponding to the various musical tones are plucked at the output timings set in the musical score data.

When the rotations of the first shaft 12 and the third shaft 26 are set to constant speeds, a time lag indicating a period of time from when the stopper 22 releases the claw 36 of the corresponding star wheel 14 to when the claw 36 plucks the corresponding vibration reed 18 is determined in advance. The release timing determination unit 64 determines the release timing based on the musical score data for the melody being played. The output timing for the musical tone corresponding to each vibration reed 18 is specified in the musical score data. Thus, the release timing determination unit 64 determines the release timing such that the stopper 22 corresponding to the vibration reed 18 releases the claw 36 of the corresponding star wheel 14 prior to the output timing by a length of time equivalent to the time lag.

The electromagnet excitation control unit 66 switches the state of each electromagnet 24 between the excitation state and the non-excitation state based on the determination results of the release timing determination unit 64. In other words, the electromagnet excitation control unit 66 controls the timing at which electricity is conducted to, and not conducted to, each of the electromagnets 24 based on the determination results of the release timing determination unit 64. For example, when the release timing determination unit 64 has determined the release timing at which the stopper 22 releases the claw 36 of the corresponding star wheel 14, the electromagnet excitation control unit 66 switches the state of the corresponding electromagnet 24 from the non-excitation state to the excitation state based on this timing. Hence, the electromagnet excitation control unit 66 begins conducting electricity to the electromagnet 24 at this timing. After switching the electromagnet 24 from the non-excitation state to the excitation state, the electromagnet excitation control unit 66 preferably switches the electromagnet 24 back to the non-excitation state after a predetermined time has elapsed. Hence, the electromagnet excitation control unit 66 halts the conduction of electricity at this timing.

Figure 6:
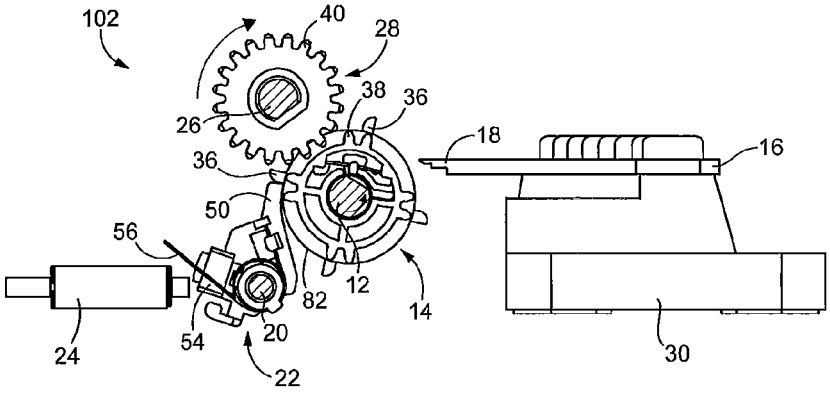
FIG. 6 is a schematic view of the mechanical performance unit when a stopper is in an anchoring state according to one or more aspects of the disclosure.

As shown in FIG. 2, the electromagnet 24 is provided for each of the stoppers 22. The electromagnet 24 is preferably positioned near the synthetic resin member 54 of the stopper 22 having the embedded magnetic member 52, but is separated from the magnetic member 52 so as not to contact the same. In other words, the anchoring member is closest to the electromagnet 24 in a closest position shown in FIGS. 7 and 8, and then the stopper 22 does not contact the electromagnet 24 in the closest position. That is, a prescribed gap is formed between the magnetic member 52 and the electromagnet 24 whether the stopper 22 is in an anchoring state or a non-anchoring state described later. This gap should fall within a range in which the magnetic force of the electromagnet 24 can affect the magnetic member 52 when the electromagnet 24 is excited. For example, the gap should be designed such that the magnetic force of the excited electromagnet 24 will attract the magnetic member 52, even when the stopper 22 is the farthest from the electromagnet 24 in a far position, as shown in FIG. 6. Moreover, the gap should be set such that the attracting force of the electromagnet 24 can rotate the stopper 22 in a direction away from the star wheel 14. As indicated by the chain line in FIG. 8, the axial center of the electromagnet 24 (central axis of the iron core) is configured to intersect the rotational center of the stopper 22 (i.e., the axial center of the second shaft 20), as will be described later.

The torsion coil spring 56 preferably urges the stopper 22 and the plate member 50 toward the star wheel 14 when the electromagnet 24 is in the non-excitation state. The plate member 50 is an anchoring state (see FIG. 6 described later) for anchoring the claws 36 provided on the corresponding star wheel 14. However, when the electromagnet 24 is in the excitation state, the magnetic force of the electromagnet 24 causes the stopper 22 and the plate member 50 to rotate about the second shaft 20 in a direction away from the star wheel 14 against the urging force of the torsion coil spring 56. The stopper 22 comes to a halt at a position in which the force of attraction on the magnetic member 52 corresponding to the magnetic force of the electromagnet 24 is counterbalanced by the urging force of the torsion coil spring 56. In this position, the stopper 22 is in the non-anchoring state (see FIGS. 7 through 9 described later) in which the plate member 50 no longer anchors the claw 36.

As illustrated in FIGS. 2 and 3, the electromagnets 24 and the stoppers 22 corresponding to these electromagnets 24 belong to either a first group or a second group. The electromagnets 24 and the stoppers 22 belonging to the first group are arranged at a 90-degree phase differential about the axial center of the first shaft 12 (at a position for forming an angle of 90 degrees) with the electromagnets 24 and the stoppers 22 belonging to the second group. If the electromagnets 24 were numbered from 1 to n from one end of the second shafts 20 to the other, the electromagnets 24 with odd numbers preferably belong to the first group while those with even numbers preferably belong to the second group. Thus, the electromagnets 24, such as the electromagnets 24*a* and 24*b* in FIG. 3 corresponding to the pair of adjacent star wheels 14*a* and 14*b*, are preferably arranged apart from each other by a phase of 90 degrees about the axial center of the first shaft 12. This configuration minimizes the space required for arranging the mechanical performance unit 100 (and particularly the electromagnets 24) in the music box 10, thereby reducing the size of the music box 10.

FIGS. 6 through 9 detail the operations of the mechanical performance unit 100 having the structure described above. When the music box 10 is playing a melody, the first shaft 12 and the third shaft 26 are constantly and synchronously driven by the motor 32 to rotate about their axial centers. As indicated by arrows in the drawings, the first shaft 12 and the third shaft 26 are driven to rotate in opposite directions. The first shaft 12 is preferably rotated such that the claws 36 provided on the star wheel 14 move in a direction for plucking the corresponding vibration reeds 18 of the corresponding vibration plate 16 upward. The third shaft 26 is rotated so that the star wheels 14 are driven to rotate in the direction indicated by the arrow when the gear teeth 38 of the star wheels 14 are engaged with the gear teeth 40 of the corresponding sun wheels 28. Since the sun wheels 28 are in capable of rotating relative to the third shaft 26, the sun wheels 28 are constantly rotated about their axial centers as the third shaft 26 rotates about its axial center while the music box 10 is playing a melody.

In the state shown in FIG. 6, electricity is not being supplied to the electromagnet 24 and thus the electromagnet 24 is in a non-excitation state. At this time, the torsion coil spring 56 urges the plate member 50 of the stopper 22 so that the stopper 22 is rotated toward the star wheel 14 and one of the claws 36 on the corresponding star wheel 14 is anchored by the stopper 22. That is, one of the claws 36 contacts the distal end of the plate member 50 on the downstream side with respect to the rotating direction of the first shaft 12 (the side in which the rotation progresses).

As described above, the star wheel 14 is configured to follow the rotation of the first shaft 12 through the frictional force generated at the point of contact with the first shaft 12. In the state shown in FIG. 6, the stopper 22 is in the anchoring state for preventing the star wheel 14 from following the rotation of the first shaft 12, despite the frictional force at the contact point therebetween. That is, the star wheel 14 provided on the first shaft 12 rotates relative to the first shaft 12, with the surfaces of contact between the assembly hole 46 of the star wheel 14 and the first shaft 12 sliding over each other with a light load, while the phase of the star wheel 14 (the positional relationship of the star wheel 14 relative to the vibration reed 18 and the like) remains fixed. In this state, the gear teeth 38 on the star wheel 14 are not engaged with the gear teeth 40 on the sun wheel 28 and, hence, the rotation of the sun wheel 28 does not affect the rotation of the star wheel 14.

When electricity is conducted to the electromagnet 24 while the mechanical performance unit 100 is in the state shown in FIG. 6, the electromagnet 24 is brought into the excitation state. The magnetic force produced by the electromagnet 24 causes the plate member 50 of the stopper 22 to rotate about the second shaft 20 against the urging of the torsion coil spring 56 in a direction away from the star wheel 14. Consequently, the plate member 50 that has anchored the claw 36 disengages therefrom, enabling the star wheel 14 to rotate together with the first shaft 12 due to the frictional force generated at the area of contact between the star wheel 14 and the first shaft 12.

Figure 7:
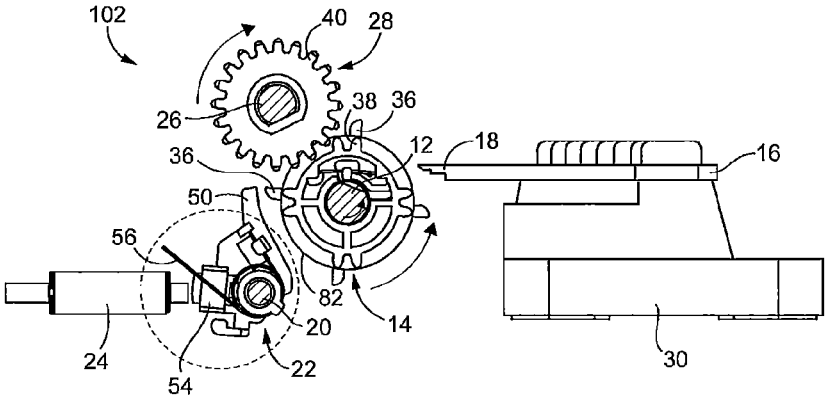
FIG. 7 is a schematic view of the mechanical performance unit when the stopper is shifted from the anchoring state to a non-anchoring state according to one or more aspects of the disclosure.
Figure 8:
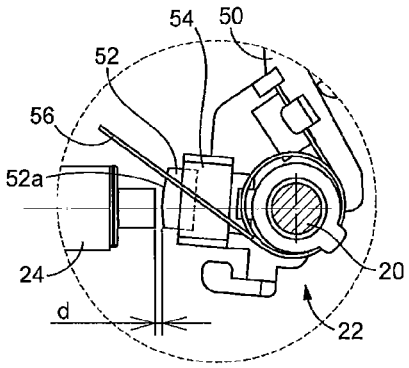
FIG. 8 is a partial enlarged view of an encircled region depicted in dashed line of FIG. 7 according to one or more aspects of the disclosure.
Figure 9:
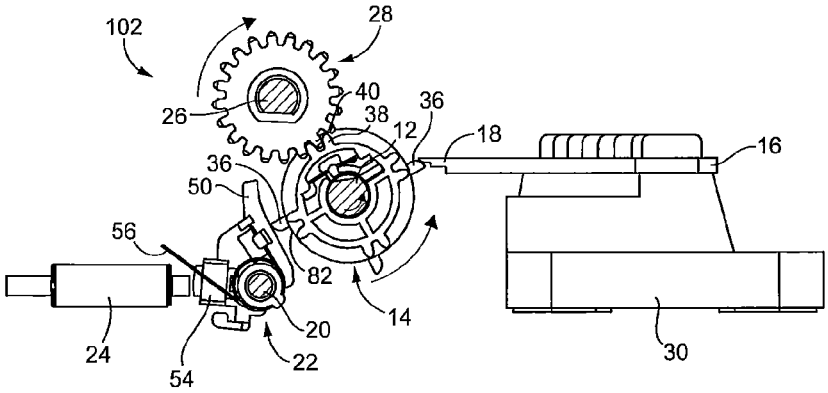
FIG. 9 is a schematic view of the mechanical performance unit when a claw of the star wheel plucks a vibration reed of a vibration plate according to one or more aspects of the disclosure.
Figure 10:
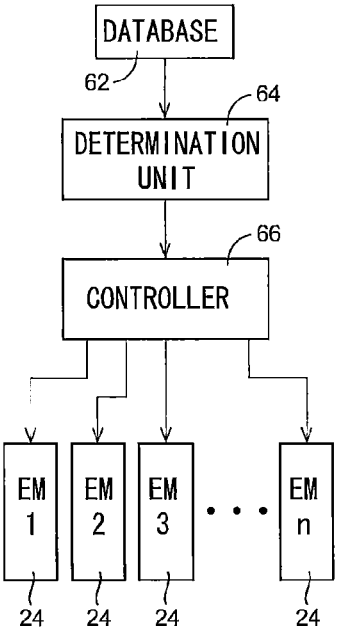
FIG. 10 is a block diagram of control functions of an electric control unit in the music box according to one or more aspects of the disclosure.

When the stopper 22 is in the non-anchoring state shown in FIG. 7, the magnetic member 52 is in the closest position to the axial center of the electromagnet 24 at the distal end thereof. In this state, the electromagnet 24 and the magnetic member 52 are not in contact with each other, and a gap d exists between the two, as shown in FIG. 8. A curved surface 52*a* is preferably formed on the side of the magnetic member 52 nearest the electromagnet 24. The curved surface 52*a* has a columnar shape centered on the second shaft 20. Hence, the gap d between the electromagnet 24 and the magnetic member 52 will not change when the stopper 22 is rotated about the second shaft 20.

When the electromagnet 24 is rendered in the non-anchoring state, the plate member 50 is disengaged from the claw 36. Subsequently, the star wheel 14 begins to follow the rotation of the first shaft 12 due to the frictional force generated at the area of contact between the first shaft 12 and the star wheel 14. When the star wheel 14 is near a phase in which one of the claws 36 contacts the corresponding vibration reed 18 on the vibration plate 16, the corresponding gear teeth 38 adjacent to the claw 36 in the rotating direction (at a phase difference of 90 degrees in the rotating direction) are engaged with the gear teeth 40 on the sun wheel 28. In this state, the rotation of the sun wheel 28 drives the star wheel 14 in the direction of the arrow indicated in FIG. 9, i.e., in a direction for moving the claw 36 upward to pluck the vibration reed 18 on the vibration plate 16. Through this operation, a sound at the tone corresponding to the vibration reed 18 is played. After the claw 36 plucks the corresponding vibration reed 18, the star wheel 14 further follows the rotation of the first shaft 12, and then the gear teeth 38 and the gear teeth 40 are brought into disengagement with each other. The conduction of the electromagnet 24 is halted to cause the electromagnet 24 to become the non-excitation state in a transition period from the state shown in FIG. 7 to a state in which the gear teeth 38 is disengaged with the gear teeth 40. Consequently, the torsion coil spring 56 urges the stopper 22 against the star wheel 14, returning a state shown in FIG. 6.

As shown in FIG. 4, the vibration plate 16 is fixed to the bedplate 30 in regions of the vibration plate 16 other than the edge along which the vibration reeds 18 are provided. The vibration plate 16 is preferably fixed to the bedplate 30 on the opposite edge from the edge on which the vibration reeds 18 are provided. As shown in FIG. 5, the bedplate 30*a* has a top portion formed with a plurality (eight in the preferred embodiment) of threaded holes 30*a* at a position where the vibration plate 16 is mounted. The vibration plate 16 is formed with through-holes 16*a* at positions corresponding to the threaded holes 30*a*. The vibration plate 16 is fixed to the bedplate 30 by inserting a plurality (eight in the preferred embodiment) of screws 42 through the through-holes 16*a* and screwing the screws 42 into the corresponding threaded holes 30*a*. While screws 42 are used to fasten the vibration plate 16 to the bedplate 30 in the preferred embodiment, the vibration plate 16 may be fixed to the bedplate 30 with adhesive, or through welding, brazing, or the like.

As shown in FIG. 4, the vibration plate 16 is provided with a plurality (forty, for example) of the vibration reeds 18. The vibration reeds 18 are formed on the vibration plate 16 with a free end on one side and a fixed end on the other side. The bedplate 30 is provided with fixing parts to which the fixed ends of the vibration reeds 18 are fixed. The fixing parts of the bedplate 30 are arranged at regular intervals that match the intervals between fixed ends of the vibration reeds 18. In the preferred embodiment, the threaded holes 30*a*, screws 42, and the like are examples of fixing parts.

As shown in FIG. 1, the plurality of vibration reeds 18 is arranged to correspond to the plurality of star wheels 14. A vibration reed 18 corresponds to a star wheel 14, which means that the claws 36 provided on the star wheel 14 are in a position capable of plucking the vibration reed 18. When the vibration plate 16 is mounted on the bedplate 30, the vibration reeds 18 are arranged along the first shaft 12. The vibration reeds 18 uniquely correspond to a plurality of preset pitches and, when plucked by claws 36 on the corresponding star wheels 14, produce sound at the corresponding pitch. Hence, the vibration reeds 18 function as the sounding bodies of the music box 10. In other words, each of the vibration reeds 18 produces sound at a different frequency when plucked by the claw 36 of the corresponding star wheel 14.

The vibration reeds 18 are arranged from the one end to the other end in order of their pitch, from high to low. In the example of FIG. 4, the vibration reeds 18 are arranged from left to right in order of high to low pitch. Each of the vibration reeds 18 has different properties. For example, the longitudinal dimensions of the vibration reeds 18 differ according to pitch. Hereinafter, the longitudinal dimension of each vibration reed 18 will be called the reed length. The reed length of a vibration reed 18 is shorter for higher pitches and longer for lower pitches. In other words, the vibration reed 18 having the highest pitch is the vibration reed 18 having the shortest reed length, while the vibration reed 18 having the lowest pitch is the vibration reed 18 having the longest reed length.

As shown in FIG. 4, the vibration reeds 18 are arranged on the vibration plate 16 in order of their reed lengths. Accordingly, the vibration reed 18 with the shortest reed length corresponding to the highest pitch is provided on one side of the plurality of vibration reeds 18 in their juxtaposed direction, while the vibration reed 18 having the longest reed length corresponding to the lowest pitch is provided on the other side. As shown in FIG. 4, the free ends of the vibration reeds 18 positioned on the star wheel 14 side are aligned with each other in the preferred embodiment, but the opposite ends, i.e., the fixed ends of the vibration reeds 18 may be aligned instead.

The sound post 76 has a hollow tube shape, for example, and is preferably made from wood, such as spruce. Alternatively, the sound post 76 may be formed of a metal. The bottom plate 34*a* of the enclosure 34 is also preferably formed from wood, such as spruce, and is made from the same wood as the sound post 76. The entire enclosure 34 including the side walls 34*b* is also preferably made from wood. As shown in FIG. 5, a threaded hole 30*b* is formed in a portion of the bedplate 30 (bottom surface) in which the sound post 76 is mounted. The bedplate 30 has a bottom surface formed with a circular recess 30*c* having a dimension in consistent with the outer diameter of the sound post 76 so as to surround the threaded hole 30*b*. The bottom plate 34*a* is formed with a through-hole 34*c* at a position corresponding to the area in which the sound post 76 is mounted. One end of the sound post 76 is fitted into the recess 30*c* of the bedplate 30, while the other end is positioned such that its hollow center is substantially aligned with the through-hole 34*c* formed in the bottom plate 34*a*. With the sound post 76 in this position, a fastening member 44 in the form of a screw is inserted through the through-hole 34*c* into the hollow center of the sound post 76 and is screwed into the threaded hole 30*b* of the bedplate 30, thereby fixing the bedplate 30, the sound post 76, and the bottom plate 34*a* together. The fastening member 44 may also be formed of wood, but is preferably configured of a metal member, such as a metal bar. The sound post 76 need not be shaped as a cylindrical or circular column, but may be configured as a square column. The sound post 76 may also be formed in the shape of a hollow tube. With the latter configuration, a screw is used to fasten one end of the sound post 76 to the bedplate 30, while another screw is used to fasten the other end of the sound post 76 to the bottom plate 34*a*.

As shown in FIG. 5, the bedplate 30 has a bottom surface formed with a threaded hole 30*d*. The bedplate 30 is fixed to the second frame 70*b* by screwing a screw 58 into the threaded hole 30*d*. The second frame 70*b* is formed with a through-hole 84 at a position in which the bedplate 30 is fixed to the second frame 70*b*. The through-hole 84 has a diameter larger than the outer diameter of the sound post 76. When the bedplate 30 is fixed to the second frame 70*b*, the through-hole 84 formed in the second frame 70*b* is preferably positioned to correspond to the recess 30*c* (threaded holes 30*a*) and has a diameter larger than the recess 30*c*. When the sound post 76 is fixed to the bedplate 30 and the bottom plate 34*a*, the sound post 76 is inserted through the through-hole 84 formed in the second frame 70*b* and fixed in a center position within the through-hole 84. Thus, when the bedplate 30, the second frame 70*b*, and the sound post 76 are fixed together, the sound post 76 is inserted through the through-hole 84 so as not to contact the second frame 70*b*. Accordingly, a prescribed gap exists between the sound post 76 and the second frame 70*b* (within the through-hole 84).

Figure 11:
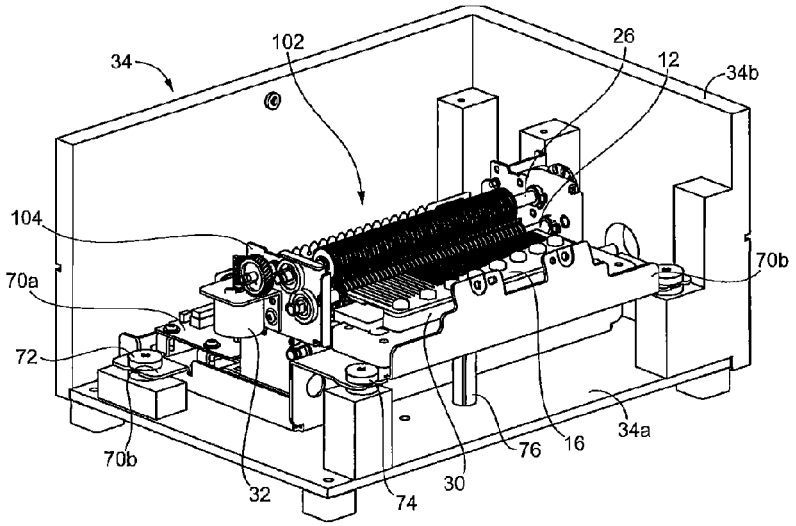
FIG. 11 is a perspective view of the music box without side walls of the enclosure according to one or more aspects of the disclosure.

As shown in FIG. 11, the sound post 76, which functions as a vibration-transmitting member, is erected between the bedplate 30 and the bottom plate 34*a*. The sound post 76 is preferably perpendicular to the bottom surface of the bedplate 30 and the top surface of the bottom plate 34*a*. Thus, the bedplate 30 and the bottom plate 34*a* (enclosure 34) are fixed to each other through the sound post 76. Accordingly, the bottom plate 34*a* is fixed at a position apart from the vibration reeds 18 that are fixed on the bedplate 30. With the sound post 76 disposed between the vibration reeds 18 fixed to the bedplate 30 and the bottom plate 34*a*, the vibration reeds 18 and the bottom plate 34*a* are separated from each other by the length of the sound post 76 in a direction orthogonal to the diameter of the sound post 76.

The sound post 76 is preferably fixed (fastened) to the bedplate 30 at a position corresponding to the low-pitch side of the vibration reeds 18 having relatively longer reed length because low-pitch vibration reeds 18 in general do not resonate in comparison with high-pitch vibration reeds 18, i.e., the sound post 76 is positioned closer to the low-pitch side than the high-pitch side in the juxtaposed direction of the vibration reeds 18. That is, the sound is small produced by a low-pitch side of vibration reeds 18 when plucked by the claw 36 on the corresponding star wheel 14. Fixing the sound post 76 to the bedplate 30 at a position on the low-pitch side of the vibration reeds 18 increases the volume for low-pitched vibration reeds 18, thereby achieving better balance across the entire range of sounds to produce uniform resonance for all notes. Alternatively, the sound post 76 may be provided in the approximate center region of the bedplate 30 with respect to the range of pitches of the vibration reeds 18 fixed to the bedplate 30.

As shown in FIGS. 5 and 12 through 14, the music box 10 is further provided with vibration-damping members 86, 88, and 90 for reducing the transmission of vibrations to components between the mechanical performance unit 100 and the enclosure 34. Preferably the vibration-damping members 86 and 88 are provided between the enclosure 34 and the second frame 70*b*, while the vibration-damping member 90 is disposed between the drive mechanism 102 (first frame 70*a*) and the second frame 70*b*.

Figure 13:
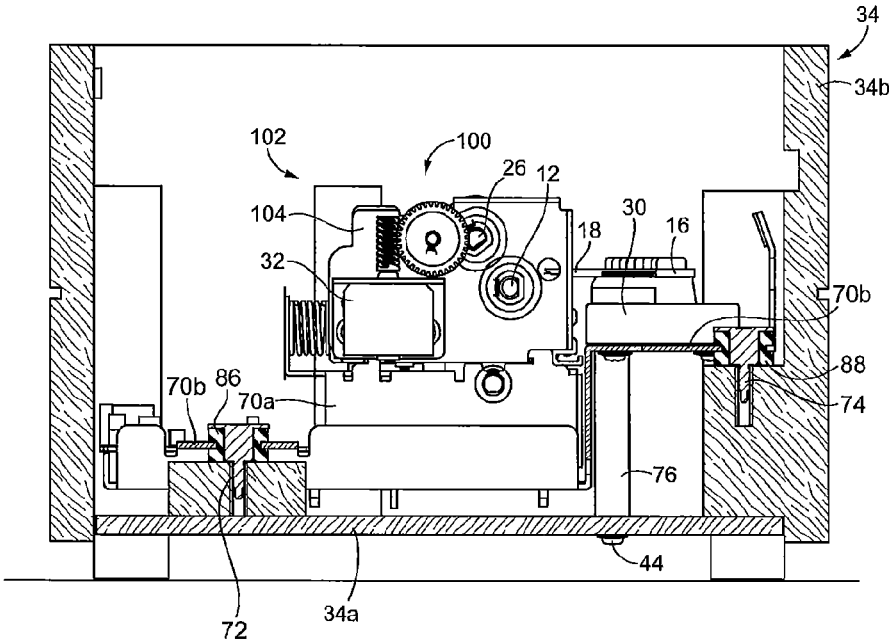
FIG. 13 is a cross-sectional view of the music box taken along a line XIII-XIII in FIG. 4 according to one or more aspects of the disclosure.

As shown in FIGS. 5 and 13, the screws 72 and 74 fastening the second frame 70*b* to the enclosure 34 are so-called shoulder screws (shoulder bolts) with a flange-like protrusion around the screw head. The vibration-damping members 86 and 88 are preferably elastic members with a rubber-like elasticity that are formed of synthetic or natural rubber, and are interposed between the screws 72 and 74 and the second frame 70*b*. Hence, the screws 72 and 74 fix the second frame 70*b* to the enclosure 34 through the vibration-damping members 86 and 88. In other words, the vibration-damping members 86 and 88 are sandwiched between the screws 72 and 74 and the second frame 70*b*. With this construction, the vibration-damping members 86 and 88 function as dampers for damping vibrations transmitted from the second frame 70*b* to the enclosure 34. In the preferred embodiment, the vibration-damping members 86, 88, and 90 are an example of second members disposed between the drive mechanism 102 and the enclosure 34 having the bottom plate 34*a*.

Figure 12:
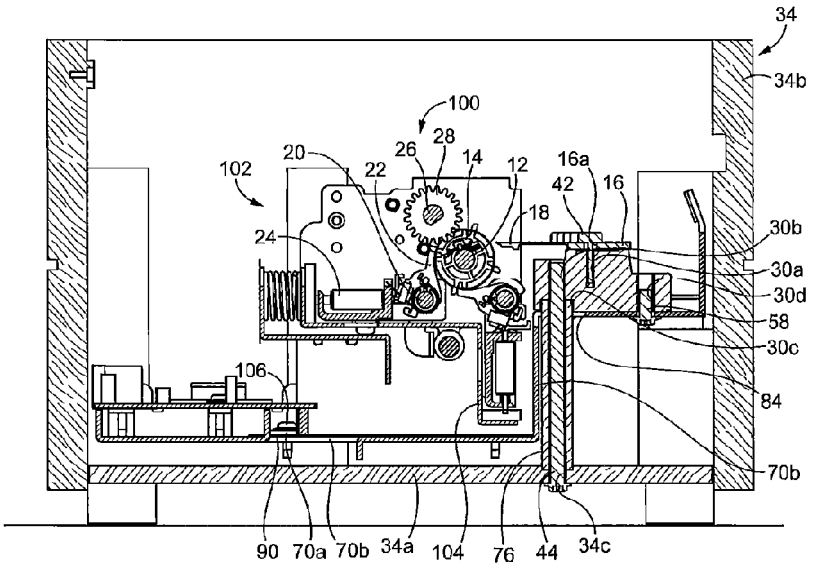
FIG. 12 is a cross-sectional view of the music box taken along a line XII-XII in FIG. 4 according to one or more aspects of the disclosure.

As shown in FIGS. 12 and 14, the vibration-damping member 90 is a mat-like (flat) member interposed between the drive mechanism 102 and the second frame 70*b* and is preferably formed of felt or another cloth having a prescribed thickness. The vibration-damping member 90 is preferably interposed between the first frame 70*a* and the second frame 70*b* and has lower elasticity than the vibration-damping members 86 and 88. Thus, in the music box 10 according to the embodiment, the elastic modulus of the vibration-damping member 90 provided between the drive mechanism 102 and the second frame 70*b* is higher than that of the vibration-damping members 86 and 88 disposed between the second frame 70*b* and the enclosure 34.

The drive mechanism 102 configured of the first shaft 12, the star wheels 14, the stoppers 22, the electromagnets 24, the third shaft 26, the sun wheels 28, and the like is mounted in the assembly frame 104. The assembly frame 104 is then mounted on the first frame 70*a*, and the first frame 70*a* is fixed to the second frame 70*b* by the screws 106 and the like with the vibration-damping member 90 interposed between the first frame 70*a* and the second frame 70*b*. In other words, the vibration-damping member 90 is sandwiched between the first frame 70*a* and the second frame 70*b*. The first frame 70*a* preferably is not in direct contact with the second frame 70*b*.

As shown in FIG. 14, a projecting part 108 provided on the first frame 70*a* projects outward like an eave over the region of the second frame 70*b* to which the first frame 70*a* is fixed. The vibration-damping member 90 is arranged between the projecting part 108 and the second frame 70*b* so as to cover at least the bottom surface of the projecting part 108 (the surface confronting the second frame 70*b*). Another vibration-damping member 90 is preferably interposed between the heads of the screws 106 fastening the first frame 70*a* to the second frame 70*b*, and the first frame 70*a*. With this construction, the vibration-damping member 90 functions as a damper for damping vibrations transferred from the drive mechanism 102 (first frame 70*a*) to the second frame 70*b*.

In the music box 10 according to the preferred embodiment described above, vibrations produced by vibration reeds 18 are effectively transmitted to the bottom plate 34*a*, serving as a resonant plate, by connecting the bedplate 30 and the bottom plate 34*a* through the sound post 76, serving as the vibration-transmitting member. Hence, vibrations produced by vibration reeds 18 are propagated to the bottom plate 34*a* via the bedplate 30 and the sound post 76. Further, drive noises produced by the drive mechanism 102 are sufficiently suppressed from resonating in the enclosure 34 by interposing the vibration-damping members 86, 88, and 90 between the drive mechanism 102 and the enclosure 34 for damping vibrations.

In addition, the vibration-damping member 90 having a relatively low elasticity is interposed between the drive mechanism 102 and the second frame 70*b*, while the vibration-damping members 86 and 88, having a relatively high elasticity higher than that of the vibration-damping member 90, are interposed between the second frame 70*b* and the enclosure 34. In other words, the vibration-damping member 90, having a relatively low capacity to deform elastically, is interposed between the drive mechanism 102 and the second frame 70*b*. Thus, the vibration-damping member 90 can suppress the transmission of vibrations from the drive mechanism 102 to the second frame 70*b* while suitably suppressing changes in distance between the claws 36 of the star wheel 14 and the vibration reed 18 due to deformation. Since changes in the distance between the claws 36 on the star wheel 14 and the vibration reed 18 varies the sound volume produced when the vibration reed 18 is plucked, this configuration suppresses unexpected variations in volume for sounds produced by the music box 10.

Further, the vibration-damping members 86 and 88 having a relatively high elasticity are interposed between the second frame 70*b* and the enclosure 34 for efficiently suppressing the transmission of vibrations from the second frame 70*b* to the enclosure 34. Hence, the preferred embodiment can provide a music box 10 that damps drive noises produced by the drive mechanism 102 while resonating sounds produced by the vibration reeds 18.

While the disclosure has been described in detail with reference to specific embodiments thereof, it would be apparent to those skilled in the art that many modifications and variations may be made therein without departing from the spirit of the disclosure.

The present disclosure is not limited to the configuration described above with reference to FIGS. 1 through 14. For example, while the first frame 70*a* and the second frame 70*b* are configured as separate members in the embodiment, they may instead be configured integrally. With this configuration, at least one of the vibration-damping members 86, 88, and 90 is interposed between the integrally configured first frame 70*a* and the second frame 70*b*, and the enclosure 34.

Further, rather than providing the assembly frame 104 in the music box 10, the drive mechanism 102 may be assembled to the first frame 70*a*. In other words, the first shaft 12, the star wheels 14, the second shaft 20, the stoppers 22, the electromagnets 24, the third shaft 26, the sun wheels 28, and the like may be assembled to the first frame 70*a*. With this configuration, at least one of the vibration-damping members 86, 88, and 90 is interposed between the first frame 70*a* and the enclosure 34.

While not specifically stated in the embodiment described above, the present disclosure is preferably applied to a music box having a volume adjusting mechanism. For example, the music box 10 described above may be provided with a volume adjusting mechanism for varying the distance between the vibration reeds 18 of the vibration plate 16 and the corresponding star wheels 14 by providing the assembly frame 104 so as to be movable relative to the first frame 70*a* and, hence, moving the assembly frame 104 relative to the first frame 70*a* along the longitudinal direction of the vibration reeds 18.

Since the drive mechanism 102 is mounted in the assembly frame 104, moving the assembly frame 104 translationally varies the distance between the star wheels 14 and the vibration reeds 18. In this way, the distance between the star wheels 14 and the corresponding vibration reeds 18 of the vibration plate 16 can be changed uniformly. Varying the distance between the claws 36 on the star wheels 14 and the vibration reeds 18 changes the volume produced when the vibration reeds 18 are plucked. Accordingly, this arrangement configures a volume adjusting mechanism capable of adjusting the volume of the music box 10.

In this type of configuration, it is particularly desirable to achieve precise adjustments in the distance between the claws 36 on the star wheels 14 and the corresponding vibration reeds 18. Such precise adjustments can be achieved by interposing the vibration-damping member 90, having a relatively low capacity for deformation, between the drive mechanism 102 and the second frame 70*b*, for example.

While the disclosure has been described in detail with reference to specific embodiments thereof, it would be apparent to those skilled in the art that many modifications and variations may be made therein without departing from the spirit of the disclosure, the scope of which is defined by the attached claims.

In short, the present disclosure is not limited to the structure described above with reference to FIGS. 1 through 14. For example, the number of claws 36 provided on each star wheel 14 is not limited to four and need not be arranged at 90-degree intervals around the periphery thereof. Further, the gear teeth 38 need not be provided at positions corresponding to the claws 36 and may be positioned at different phases around the periphery of the star wheel 14.

Further, the electromagnets 24 and the stoppers 22 belonging to the first group and the electromagnets 24 and the stoppers 22 belonging to the second group need not be disposed at 90-degree intervals in a circumferential direction around the axial center of the first shaft 12. For example, all electromagnets 24 may be juxtaposed along the same plane. Conversely, if five or more of the claws 36 were provided around the periphery of the star wheel 14, for example, pluralities of the electromagnets 24 and stoppers 22 could be arranged at positions corresponding to three or more phases spaced at prescribed phase differences in a circumferential direction around the axial center of the first shaft 12, depending on the number of claws 36 provided. Further, two or more of the stoppers 22 may be provided for each star wheel 14 as the mechanism for anchoring the star wheel 14.

The ECU 60 may also be connected to the Internet or another communication link and may be configured to download musical score data via the communication link and store this data in the musical score database 62.

In addition, the shape of the star wheel 14, structure of the stopper 22 (shape of the plate member 50), phase positions of the various components, and the like may be modified as needed to suit the design of the music box. For example, the gear teeth 38 need not be provided in pairs, but may be provided in groups of one or three or more, provided that the sun wheel 28 can drive the star wheel 14 a sufficient distance and time interval for allowing the claw 36 to pluck the corresponding vibration reed 18 of the vibration plate 16.

The stopper 22 may also be provided with a permanent magnet as the magnetic member. When the electromagnet 24 is in an excitation state, the magnetic force of the electromagnet 24 causes the permanent magnet to rotate the stopper 22 in a direction away from the star wheel 14. The permanent magnet is preferably formed in the synthetic resin member 54, which is integrally provided with the plate member 50, through insert molding, and is preferably positioned to produce a repelling force (force of repulsion between like magnetic poles) with the electromagnet 24 when the electromagnet 24 is excited. The magnetic force of the electromagnet 24, i.e., the force of repulsion produced between the electromagnet 24 and the permanent magnet, moves the plate member 50 of the stopper 22 against the urging force of the torsion coil spring 56. Accordingly, the stopper 22 rotates about the third shaft 20 in a direction away from the star wheel 14, thereby disengaging the plate member 50 from the claw 36 and placing the stopper 22 in the non-anchoring state.

What is claimed is:

1. A music box comprising:

a bedplate fixedly provided with a plurality of vibration reeds;

a plurality of projections, one or more projections being provided to correspond to each of the plurality of vibration reeds;

a driving mechanism configured to drive the plurality of projections;

an enclosure accommodating therein the bedplate and the driving mechanism and comprising a resonant plate;

a first member fixed to the resonant plate of the enclosure and the bedplate accommodated in the enclosure, the first member being interposed between the bedplate and the resonant plate;

a second member provided between the driving mechanism and the enclosure;

a frame fixing the bedplate and the driving mechanism to the enclosure, wherein the second member comprises a third member provided between the enclosure and the frame, wherein the first member has a column shape having a first diameter, wherein the frame is formed with a through hole having a second diameter larger than the first diameter, and wherein the first member is inserted into the through hole with a gap therebetween.

2. The music box according to claim 1, wherein the first member and the resonant plate is made from wood, and wherein the first member is fixed to the resonant plate and the bedplate by a fastening member.

3. The music box according to claim 1, wherein the plurality of vibration reeds has a reed length different from each other, the plurality of vibration reeds being arranged in order of the reed length thereof and including one side having a first vibration reed and the other side having a second vibration reed longer than the first vibration reed, and wherein the first member is fixed at a position corresponding to the other side.

* * * * *